US007129432B2

(12) United States Patent
Fujii et al.

(10) Patent No.: US 7,129,432 B2
(45) Date of Patent: Oct. 31, 2006

(54) LIGHTED SWITCH UNIT

(75) Inventors: Takeshi Fujii, Tsuruga (JP); Koichi Santo, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/057,504

(22) Filed: Feb. 14, 2005

(65) Prior Publication Data

US 2005/0189205 A1 Sep. 1, 2005

(30) Foreign Application Priority Data

Mar. 1, 2004 (JP) ..... 2004-055958
Aug. 20, 2004 (JP) ..... 2004-240470

(51) Int. Cl.
*H01H 9/00* (2006.01)

(52) U.S. Cl. ..... 200/314; 200/310; 200/313

(58) Field of Classification Search ..... 200/310, 200/311, 313, 314
See application file for complete search history.

(56) References Cited

U.S. PATENT DOCUMENTS 5,584,381 A * 12/1996 Brundage et al. ..... 200/315
6,326,569 B1 * 12/2001 Ardrey et al. ..... 200/314
6,670,565 B1 * 12/2003 Hanahara et al. ..... 200/314
6,747,402 B1 * 6/2004 Hato et al. ..... 313/305
6,809,273 B1 * 10/2004 Ito et al. ..... 200/5 R
6,960,733 B1 * 11/2005 Hanahara et al. ..... 20/314

FOREIGN PATENT DOCUMENTS

JP 2001-283673 10/2001

* cited by examiner

*Primary Examiner*—Elvin Enad
*Assistant Examiner*—Lheiren Mae A. Anglo
(74) *Attorney, Agent, or Firm*—RatnerPrestia

(57) ABSTRACT

A lighted switch unit having a light-shield structure at a lower end of an operating body is provided, in which an outer surface of the operating body is covered with a non-translucent covering layer, and a light-transmitting display part is formed on an upper part or side part of the body. The light-shield structure is such as an inclined part formed on an outer surface at the lower end of the operating body, with which an exposed area of a lower end of the inner surface of the operating body is made small so that an amount of a light that leaks out of a gap between the cover and the operating body is reduced. Thus, a lighted switch unit having good visibility is obtained with a simple structure.

4 Claims, 4 Drawing Sheets

LIGHTED SWITCH UNIT

TECHNICAL FIELD

This invention relates to lighted switch units to be used for mainly controlling automotive audio equipments and air-conditioners.

BACKGROUND OF THE INVENTION

In recent years, automobiles equipped with a plurality of lighted switch units in the front panels are increasing. Those lighted switch units may have push switches or rotary switches for easily controlling audio equipments, air-conditioners or other various electronic equipments.

A conventional lighted switch unit is explained using FIG. 5. The conventional lighted switch unit 501 includes operating body 1 made of insulating resin. Operating body 1 includes transparent or milky-white transparent part 1A; black or dark gray covering layer 1B formed by a painting method for instance in covering an entire outer surface of transparent part 1A; and light-transmitting display part 1C formed on an upper part of the operating body in exposing a part of transparent part 1A in a shape of letters and symbols.

Lighted switch unit 501 further includes case 2 made of insulating resin, and cover 3 made of insulating resin. In a middle part of case 2, cylindrical hollow part 2A is opened upward. Operating body 1 is placed movably in up and down directions and surrounds cylindrical hollow part 2A. Cover 3 covers an upper part of case 2. Operating body 1 extrudes upward from opening part 3A of an upper part of cover 3.

Printed wiring board 4 has a plurality of conductive patterns formed on an upper side and a bottom side of the board, and push switch 5 is mounted on the board. Depressing part 1D extends downward from an inside part of operating body 1 and contacts with operating part 5A of push switch 5.

On printed wiring board 4, electronic components including connector 6 (not illustrated) and light-emitting element 7, such as a light-emitting diode, are also mounted. Light-emitting element 7 is mounted near push switch 5.

Lighted switch unit 501 is installed in a front panel of automobile and is electrically connected to various electronic equipment including audio equipment and an air-conditioner as well as to an electronic circuit of automobile (not illustrated), through push switch 5 and light-emitting element 7.

When operating body 1 of lighted switch unit 501 is depressed, operating part 5A of push switch 5 is depressed by depressing part 1D electrically operating push switch 5; hence controlling audio volume and temperature of air-conditioner. When light-emitting element 7 emits light, an entire part of operating body 1 is lighted, illuminating light-transmitting display part 1C in a shape of letters and symbols. Thereby, a display of display part 1C and a position of operating body 1 are easily identified even in dark place or in night time. A similar illuminating switch is disclosed in Japanese Patent Unexamined Publication No. 2001-283673 for instance.

However, with the above conventional lighted switch unit, when light-emitting element 7 emits light illuminating the entire part of transparent part 1A which is at an inner surface of operating body 1, light transmitted to lower end 1E of transparent part 1A is reflected by case 2 leaking out through a gap between operating body 1 and opening part 3A of cover 3 as it is indicated by an arrow in FIG. 5. The leaked light makes the display of display part 1C hard to be seen. Thus, the device has a problem that the visibility of display part 1C is diminished.

SUMMARY OF THE INVENTION

A lighted switch unit according to the present invention has an inclined part which is inwardly inclined or outwardly inclined and is formed at a lower end of an outer surface or an inner surface of an operating part. The outer surface of the operating part is covered with a non-translucent layer and an upper surface or a side surface of the operating part has a light-transmitting display part. An exposed area at a lower end of a transparent part of the operating body becomes small, so that light leaking out of a gap between a cover and the operating body is reduced. Thus a lighted switch unit having a clearly visible display in the operating part is provided with a simple structure.

DESCRIPTION OF THE INVENTION

To solve the problem of the conventional lighted switch unit 501, namely improving the leakage of light out of lower end 1E of transparent part 1A, a structure of the device having a light-shielding layer coated over lower end 1E has been examined. By having this kind of light-shielding layer on the lower end face, visibility of display part 1C has been improved. However, following new problems have been arisen, such as an increased production process or reduced production efficiency due to necessity of handling every individual operating body.

To solve the arisen problems, the lighted switch unit according to the present invention includes a case; an operating body covering an upper part of the case, being held by the case movably in up and down directions, and including a non-translucent or light-shielding covering layer covering an outer surface of the operating body and a light-transmitting display part formed on an upper or a side part of the operating body; a cover having an opening in an upper part thereof through which the operating body is placed movably in up and down directions with a prescribed gap, and covering the case; and a light-emitting element disposed under the operating body, in which the operating body has a light-shield structure disposed at the lower end of the operating body for preventing light emitted out of the operating body from being leaked outside through the gap. As the light-shield structure reduces an exposed area of the lower end of the transparent part of the operating body, light leakage out of the gap between the cover and the operating body is reduced. The light-shield structure in this invention includes the inclined part formed at the lower end of operating body 11 as its constituent element. With such a simple structure, a lighted switch unit having a clearly visible display image is obtained. Because the shield cover can be collectively processed over a multiple of operating bodies by printing or painting for instance, an increase of production process or a reduction of productivity is avoided compared with a case of conventional lighted switch unit 501.

The lighted switch unit according to the invention can have an outwardly extended end-portion at an outer surface of a lower end of the operating body for effectively covering the gap between the cover and the operating body. The outwardly extended end-portion further decreases the leakage of light. The light-shield structure in this case includes rim 11F formed at the lower end of operating body 11 as its constituent element.

Next, exemplary embodiment of the present invention is explained using FIG. 1 to FIG. 4. A same reference mark is used for constitutional parts of the invention as long as they are used similarly as the background of the invention, hence detailed explanation of the mark is omitted.

Exemplary Embodiments

Figure 1:
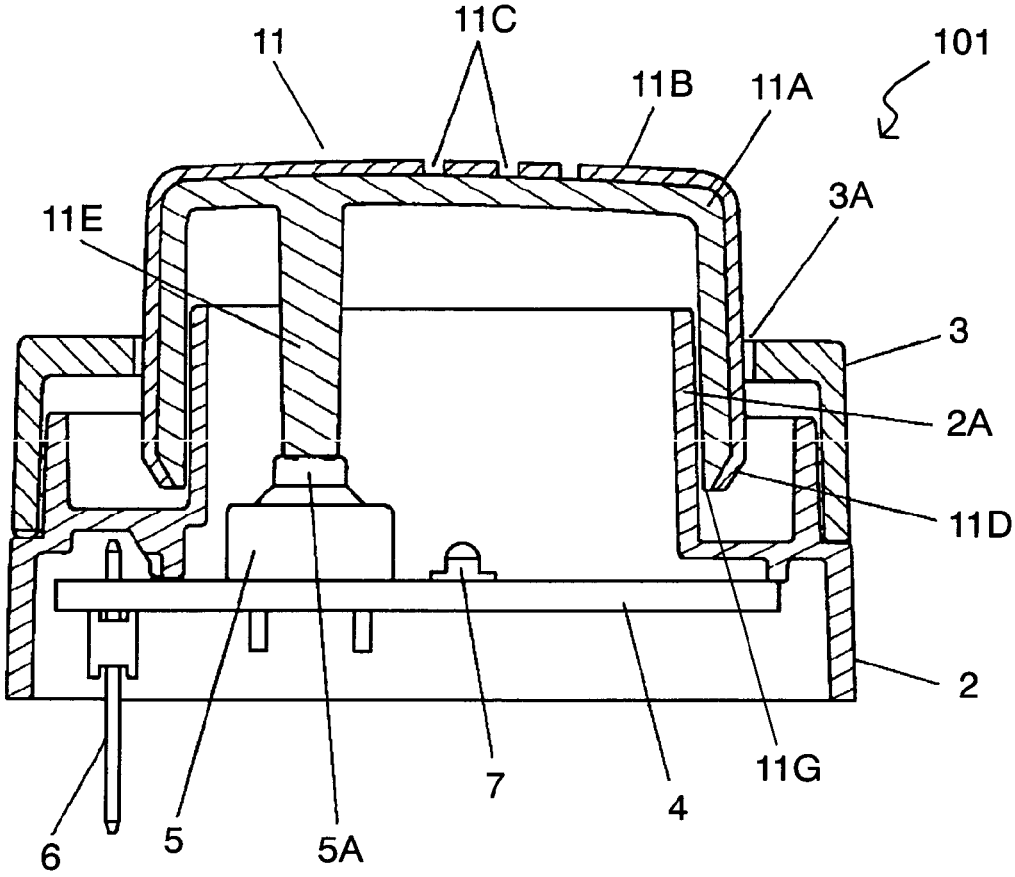
FIG. 1 is a cross-sectional view of a lighted switch unit in accordance with an exemplary embodiment of the present invention.
Figure 2:
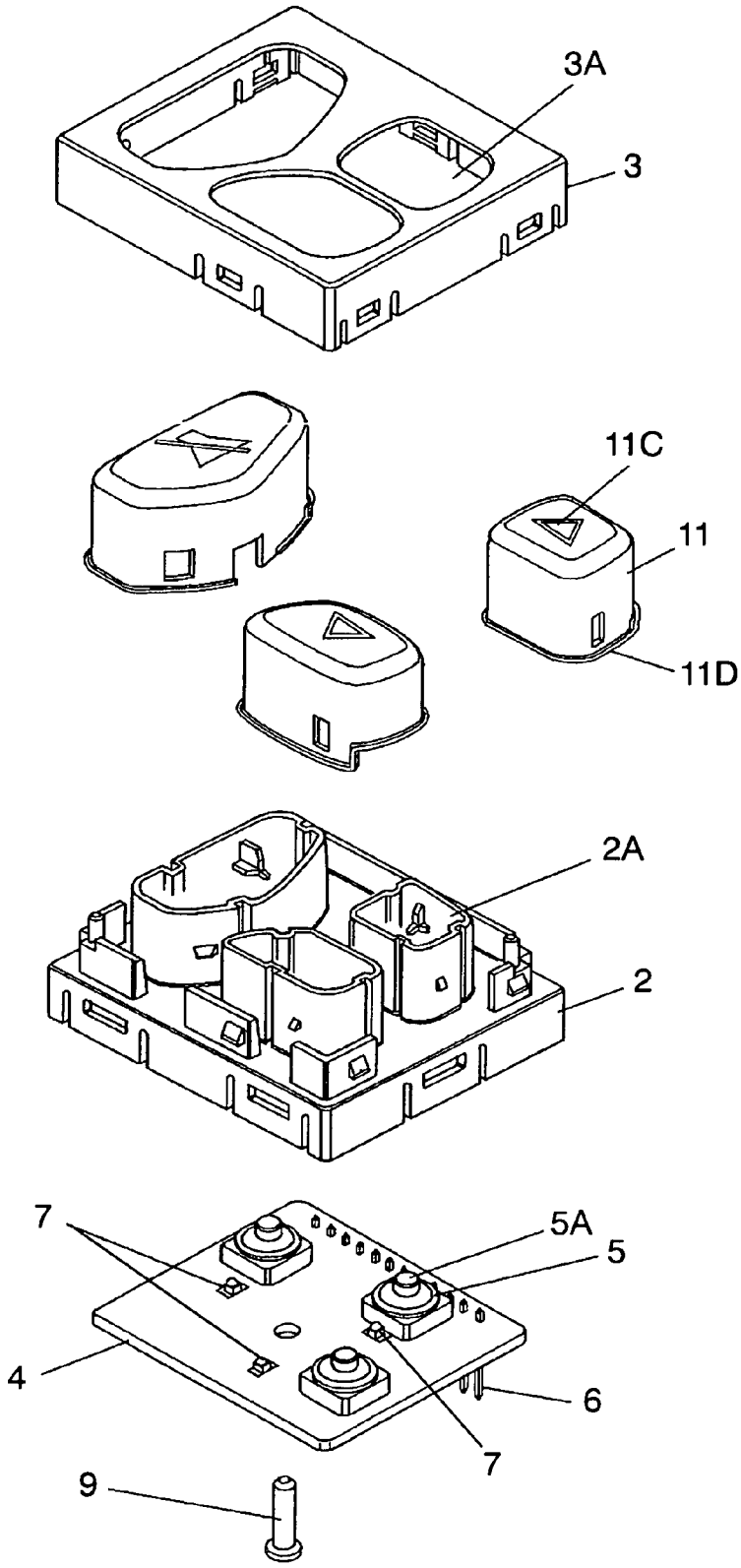
FIG. 2 is an exploded perspective view of the lighted switch unit in accordance with the exemplary embodiment of the present invention.

FIG. 1 and FIG. 2 explain lighted switch unit 101 according to an exemplary embodiment of the present invention. Lighted switch unit 101 includes operating body 11 which is a molded part of insulating resin such as acrylic resin or polycarbonate resin. Operating body 11 is composed of transparent or milky-white transparent part 11A, and black or dark-gray shielding covering layer 11B formed on transparent part 11A by painting or two-color molding. On an upper part of operating body 11, light-transmitting display part 11C exposing transparent part 11A in a shape of letters and symbols is formed. At an outer surface of a lower end of display part 11, inclined part 11D is formed inwardly inclined at an outer surface of the lower end of operating part 11. By forming inclined part 1D, exposed dimension of lower end 11G of transparent part 11A is reduced. Inclined part 11D can be molded together when operating body 11 is molded.

Lighted switch unit 101 further includes case 2 made of insulating resin typically polyoxymethylene, and cover 3 made of insulating resin: ABS or polycarbonate typically. In a middle part of case 2, cylindrical hollow part 2A is formed as opening; and operating body 11 is disposed surrounding cylindrical hollow part 2A movably in up and down directions. Cover 3 covers an upper part of case 2, and operating body 11 protrudes upwardly from an opening part 3A of an upper part of cover 3.

Printed wiring board 4 made of paper phenol or glass epoxy is placed in case 2. Printed wiring board 4 has a plurality of conductive patterns (not shown) made of copper foil or the like formed on an top and bottom face of the board. Push switch 5 is mounted on the top face of the board. Depressing part 11E extending downward from an inside part of operating body 11 comes into contact with operating part 5A of push switch 5.

On printed wiring board 4, electronic components including connector 6 (not shown) and light-emitting element 7 such as a light-emitting diode are also mounted. Light-emitting diode is mounted near push switch 5. Printed wiring board 4 is fixed to case 2 with screws 9 or the like, constituting the lighted switch unit.

The lighted switch unit thus produced is installed in a front panel of automobile, in which push switch 5 and light-emitting element 7 are electrically connected to various electronic equipment such as audio equipment and an air-conditioner, as well as to electronic circuits of the automobile (not illustrated), through connector 6.

With above constitution, when operating body 11 is pressed, depressing-part 11E depresses operating-part 5A, electrically operating push switch 5 and controlling volume of audio equipment and temperature of an air-conditioner.

When light-emitting element 7 emits light by operating push switch 5, the light illuminates an entire part of transparent part 11A of operating body 11, illuminating display part 11C in the shape of letter and/or symbol. Therewith, an image of display part 11C and a location of operating body 11 are easily identified even in dark place or in night time.

As described, lighted switch unit 101 according to the exemplary embodiment has inclined part 11D inwardly inclined at the outer surface of the lower side of operating part 11, with which an exposed area of lower end 11G of transparent part 11A is reduced. In this constitution, when the entire part of transparent part 11A of operating body 11 is illuminated by light-emitting element 7, amount of the light outgoing from lower end 11G of transparent part 11A and reflecting on inside of case 2 is reduced, thereby the light leaking out the gap between opening part 3A of cover 3 and operating body 11 is reduced.

As described, lighted switch unit 101 in the exemplary embodiment is equipped with inclined part 11D which is inwardly inclined, formed at the lower outer surface of operating body 11, and inclined part 11D works as a light-shield structure. The lighted switch unit having a clearly visible display of operating part 11A is thus obtained with such a simple construction.

Figure 3:
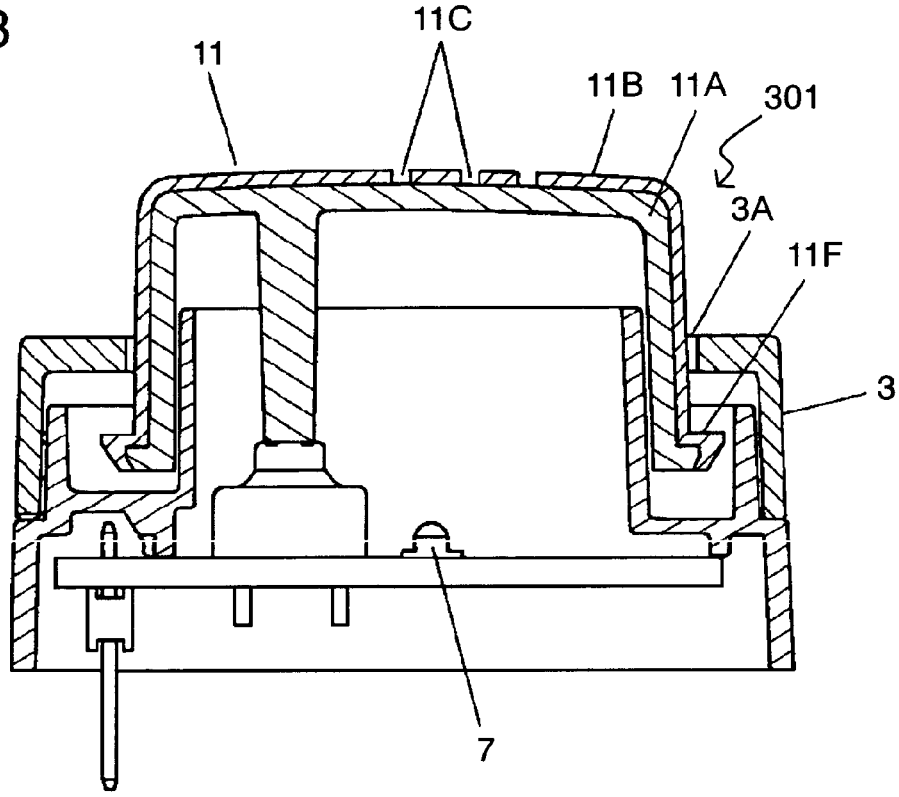
FIG. 3 is a cross-sectional view of other lighted switch unit in accordance with the exemplary embodiment of the present invention.

Lighted switch unit 301 shown in FIG. 3 has another type of light-shield structure: rim 11F in which the outer surface of the lower end of operating body 11 is extended outwardly. Because rim 11F shields a gap between case 2 and operating body, amount of light reaching the gap between opening part 3A of cover 3 and operating body 11 is reduced, and total amount of light leakage is further reduced. Rim 11F can be produced together with operating body 11 when the operating body is molded.

Figure 4:
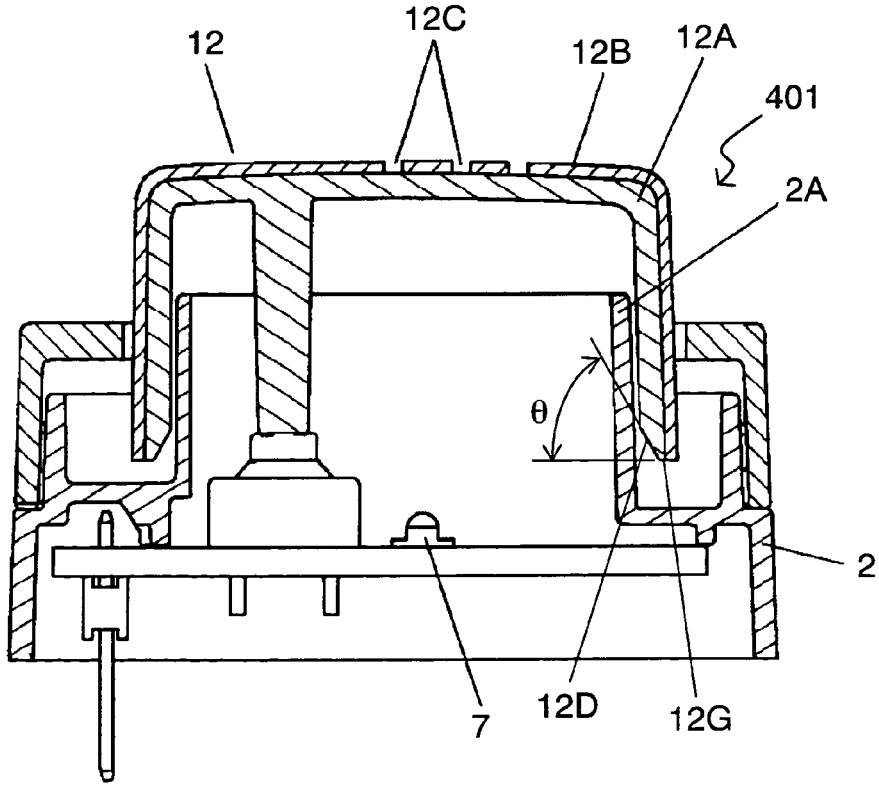
FIG. 4 is a cross-sectional view of still other lighted switch unit in accordance with the exemplary embodiment of the present invention.
Figure 5:
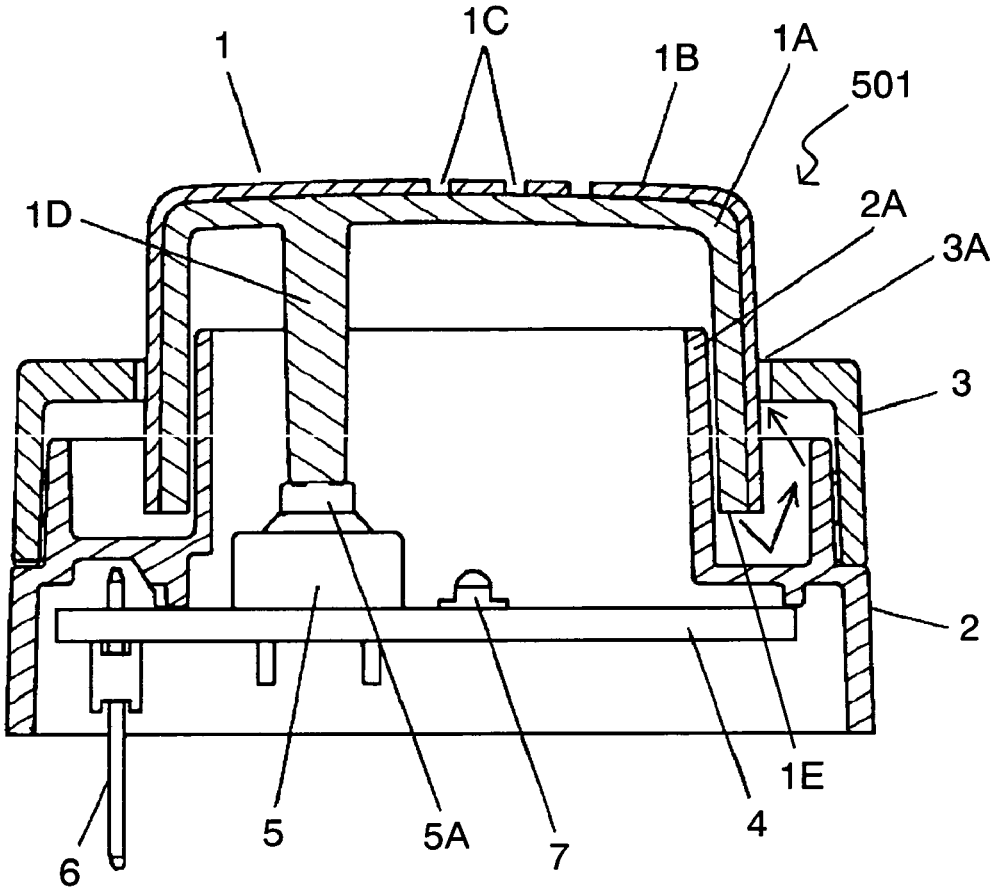
FIG. 5 is a cross-sectional view of a conventional lighted switch unit.

Lighted switch unit 401 shown in FIG. 4 has still another type of light-shield structure. Lighted switch unit 401 has inclined part 12D outwardly inclined at an inner surface of the lower end of operating part 12, transparent part 12A of which outside surface is covered with covering layer 12B and display part 12C formed on an upper part of the display part. Inclined part 12D reduces exposed area of lower end 12G of transparent part 12A and reduces leakage of the light of lighted switch unit 401. Inclined part 12D can be produced together with the operating body 12 when the body is molded.

In lighted switch unit 401, a surface of inclined part 12D is made highly refractive or flat so that total reflection of the light may be easy to occur, otherwise an inclined angle θ of inclined part 12D may be made larger than an angle at which the total reflection occurs. With the arrangement, the light inside transparent part 12A is totally reflected by inclined part 12D so that leakage of the light is further reduced. The inclined angle is set 42° or larger so that the angle is not less than critical angle at which the total reflection of light occurs.

It is also possible to reduce the exposed lower end area of transparent part 11A or 12A by forming the inclined parts at both of the outer surface and the inner surface of the lower end of operating body 11 or 12, instead of forming it in one of inclined part 11D and 12D at the lower end of operating body 11 or 12. In other word, inclined part 12D is formed at the inner surface and, at the same time, inclined part 11D or rim 11F can be formed at the outer surface of the operating body.

In the above explanation, light-transmitting display part 11C or 12C is formed on the upper part of operating body 11 or 12, but display part 11C or 12C can be formed also at a side of operating body 11 or 12.

In the above explanation, push switch 5 which is mounted on printed wiring board 4 is depressed by operating body 11 or 12. Yet, other type of push switch having a different structure can also be used in embodying the concept of the invention. A rotary type switch or a variable resistor can as well be used for this application.

The invention according to the present invention realizes a lighted switch unit having an easy-to-see display with a simple structure, the lighted switch unit primarily useful for controlling automotive audio equipment and an air-conditioner.

What is claimed is:

1. A lighted switch unit comprising:

a case;

an operating body covering an upper part of the case and being held by the case movably in up and down directions, the operating body including a non-translucent covering layer covering an outer surface of the operating body and a light-transmitting display part formed on an upper part or on a side part of the operating body;

a cover covering the case, the cover having an opening part in an upper part thereof through which the operating body is placed movably in up and down directions with a prescribed gap; and a light-emitting element disposed under the operating body, wherein the operating body has a light-shield structure formed at a lower end of the operating body for preventing a light emitted out of the operating body from being leaked outside through the gap, and wherein the light-shield structure is composed of an inclined part formed at the lower end of the outer surface of the operating body, the inclined part gradually reduces the thickness to the lower end, and the covering layer covers the inclined part.

2. A lighted switch unit comprising:

a case;

an operating body covering an upper part of the case and being held by the case movably in up and down directions, the operating body including a non-translucent covering layer covering an outer surface of the operating body and a light-transmitting display part formed on an upper part or on a side part of the operating body;

a cover covering the case, the cover having an opening part in an upper part thereof through which the operating body is placed movably in up and down directions with a prescribed gap; and a light-emitting element disposed under the operating body, wherein the operating body has a light-shield structure formed at a lower end of the operating body for preventing a light emitted out of the operating body from being leaked outside through the gap, and wherein the light-shield structure includes an inclined part formed at a lower end of an inner surface of the operating body, the inclined part gradually reduces the thickness to the lower end.

3. A lighted switch unit comprising:

a printed wiring board including push switch and a light-emitting element on the top face;

a case including a side and an upper part having a cylindrical hollow part protruding upwardly, the printed wiring board being placed in the case;

a cover including a side and an upper part having an opening part;

an operating body including a side and an upper part; wherein the opening part of the cover opens at a position corresponding to the cylindrical hollow part of the case, the cylindrical hollow part of the case is inserted in the opening part of the cover, the operating body includes:

a non-translucent covering layer covering the side and the upper part of the operating body;

a light-transmitting display part formed on the upper part of the operating body; and a depressing part extending downward from the upper part and contacting with the push switch;

the operating body is inserted in the opening part of the cover with a prescribed gap and covers the cylindrical hollow part movably up and down; and the operating body has a light-shield structure formed at a lower end of the operating body, the light-shield structure prevents a light emitted out of the operating body from being leaked outside through the prescribed gap, and wherein the light-shield structure is composed of an inclined part formed at the lower end of the outer surface of the operating body, the inclined part gradually reduces the thickness to the lower end, and the covering layer covers the inclined part.

4. A lighted switch unit comprising:

a printed wiring board including a push switch and a light-emitting element on the top face;

a case including a side and an upper part having a cylindrical hollow part protruding upwardly, the printed wiring board being placed in the case;

a cover including a side and an upper part having an opening part;

an operating body including a side and an upper part; wherein the opening part of the cover opens at a position corresponding to the cylindrical hollow part of the case, the cylindrical hollow part of the case is inserted in the opening part of the cover, the operating body includes:

a non-translucent covering layer covering the side and the upper part of the operating body;

a light-transmitting display part formed on the upper part of the operating body; and a depressing part extending downward from the upper part and contacting with the push switch;

the operating body is inserted in the opening part of the cover with a prescribed gap and covers the cylindrical hollow part movably up and down; and the operating body has a light-shield structure formed at a lower end of the operating body, the light-shield structure prevents a light emitted out of the operating body from being leaked outside through the prescribed gap, and wherein the light-shield structure includes an inclined part formed at a lower end of an inner surface of the operating body, the inclined part gradually reduces the thickness to the lower end.

* * * * *